United States Patent [19]

Dreiling et al.

[11] Patent Number: 4,509,281

[45] Date of Patent: Apr. 9, 1985

[54] GUN TRIGGER LOCK

[76] Inventors: Ronald Dreiling, 24528 Kansas St., Newhall, Calif. 91321; Blaine Perrella, 17357 Chase St., Northridge, Calif. 91325

[21] Appl. No.: 409,450

[22] Filed: Aug. 19, 1982

[51] Int. Cl.[3] ..... F41C 27/10

[52] U.S. Cl. ..... 42/1 Y; 42/1 LP

[58] Field of Search ..... 42/1 LP, 1 Y

[56] References Cited

U.S. PATENT DOCUMENTS

| | | | |
|---|---|---|---|
| 1,686,482 | 10/1928 | Windle | 42/1 Y |
| 2,893,152 | 7/1959 | Peluso | 42/1 Y |
| 3,139,694 | 7/1964 | Schaefer | 42/1 Y |
| 4,030,221 | 6/1977 | Doobenen et al. | 42/1 Y |

*Primary Examiner*—Charles T. Jordan
*Attorney, Agent, or Firm*—David O'Reilly

[57] ABSTRACT

A gun trigger locking device comprised of two members adapted to fit around the trigger and trigger guard on a gun to prevent firing of the gun. The two members are adapted to mate and surround the trigger, preventing movement in any direction. A shaft and socket are arranged to secure the two members together and prevent the trigger locking device from being easily removed. This is accomplished by a biasing means between the shaft and the socket which requires opposite axial forces to be simultaneously applied to separate the shaft from the socket. The socket has a knob containing a threaded insert and rod extending into the socket which is externally adjustable to vary the depth of the socket. When the insert is adjusted it prevents any separation of the shaft and socket. The insert is keyed by means of an unusually shaped socket in which a separate tool or key must be inserted to adjust the insert. A cable is provided in slots on either side of the locking device and can be wrapped around or secured to a post or some other suitable fixed means to secure the gun and prevent theft.

27 Claims, 7 Drawing Figures

GUN TRIGGER LOCK

FIELD OF INVENTION

This invention relates to safety devices for guns and more particularly relates to a gun trigger locking device.

BACKGROUND OF THE INVENTION

A variety of devices have been designed to provide safety locking features for firearms. Some of these involve built in safety latches which prevent the hammer from being moved while others are in the form of devices which surround the trigger and trigger guard, preventing movement of the trigger.

One such device is disclosed and described in U.S. Pat. No. 2,664,658 and is comprised of a pair of mating members fitting the trigger guard of a pistol which surrounds and substantially immobilizes the trigger. In this device, two members, having recesses fitting the shape of the trigger, are placed on either side of the trigger and secured with a locking mechanism having a keyed lock passing through the first member and secured to a slot in the second member. To remove the device, the lock is opened with a key releasing one of the pieces, allowing it to be removed from the trigger guard. The members which surround the trigger are in the form of plates with the lock being secured to one of the plates by a keeper ring. When the lock is opened, the other plate can be removed to remove the trigger locking device. Thus, this device has two separate pieces in addition to having a particular keyed lock to which a key must be found for operation. Additionally, even if the key is available, opening the lock, particularly in the dark, is not always easily accomplished. When a gun is used to protect the home, the last thing one wishes to do is to fumble for a key in the dead of night.

Therefore, an objective of the present invention is to provide a gun trigger locking device which is easily installed and removed.

Yet another object of the present invention is to provide a gun locking device in which no special keys are normally required to remove the gun lock.

Still another object of the present invention is to provide a gun locking device which is substantially child proof.

Another object of the present invention is to provide a gun locking device which requires both hands and opposite axial forces to be applied to remove the lock.

Another object of the invention is to provide a gun locking device having a cable so that the gun can be locked to a fixed object such as a post as an anti-theft measure.

SUMMARY OF THE INVENTION

The purpose of the present invention is to provide a gun locking device which is easy to install and remove but requires manipulations which make it substantially child proof.

These purposes are achieved by providing two members which fit around the trigger and trigger guard, preventing movement of the trigger. The two members are connected by a hinge and mate with each other to surround the trigger. A shaft and socket are provided for securing the two members together after they are fitted around the trigger. The shaft and socket are constructed and arranged in such a way that opposite axial forces must be applied to each to remove the gun locking device from the trigger guard.

This is accomplished by providing a socket secured to one of the members which mates with a shaft secured to the other of the members, having a spring between the two members which biases the shaft and socket apart. Thus, when one is trying to remove or unlock the device, axial forces must be applied both to the shaft and to the socket to separate them. A pin on the shaft fits an angle slot in the end of the socket so that in addition to the axial forces, a rotational motion must be applied. Thus, even if the proper axial forces should be applied, it takes some manipulation to remove the gun locking device.

This, this manipulation makes the gun locking device essentially child proof because there is manipulative skill required. Usually both hands must be used to apply opposite axial forces to push the shaft and the socket together while also applying a slight twisting motion to release or engage a pin in the shaft from an angle slot in the end of the socket.

In order to provide a positive lock, a knob is provided on the socket and an insert having an outward extending rod is provided. The insert is threaded into the knob and extends part way into the socket. A hole through the knob provides an external access to the insert to adjust it to extend the rod toward the shaft. The threaded portion of the insert is sufficiently long that the rod can be adjusted to prevent or minimize axial movement of the shaft with respect to the socket, which will prevent the pin from being released from the angle slot. The insert can be provided with an ordinary allen screw socket, thus requiring a particular size allen screw to manipulate it, or can be provided with a keyed special designed socket which will require a special tool to release the lock. In this manner, the gun locking device can be positively locked, making it difficult for someone to unlock it.

An added feature is the deceptive lock achieved by inscribing numbers or characters on the outer surface of the knob to make it appear as though the gun locking device has some type of combination lock. This will further confuse children or others who are not knowledgeable of the manner in which the lock operates.

Often, a gun is kept at bedside for protection and the user wants to be able to release it from its lock in the dark. Further, the user would like to have the gun readily available. A difficulty with this is that with a gun readily visible on a bedside table, any person could simply pick it up and walk away with it. The gun locking device of the present invention prevents this by providing slots at a lower end of the locking device for insertion of cable ends, providing a cable which can be secured around some type of fixed object, such as a bedpost. Thus, removal of the gun locking device not only releases the trigger but frees it for use.

The cable can not only be used to lock the gun to a fixed object but also can be used to lock a plurality of guns together. With the trigger lock installed in one of the guns, the cable can be passed through the triggers of a number of other guns, securing them all together. Thus, in order to get out one of the guns the gun lock would have to be released from the trigger to which it is attached.

These and other objects, advantages and novel features of the invention become apparent from the following detailed description when considered in conjunction with the accompanying drawings, where like reference numbers identify like parts throughout in which:

DETAILED DESCRIPTION OF THE PREFERRED EMBODIMENT

Figure 1:
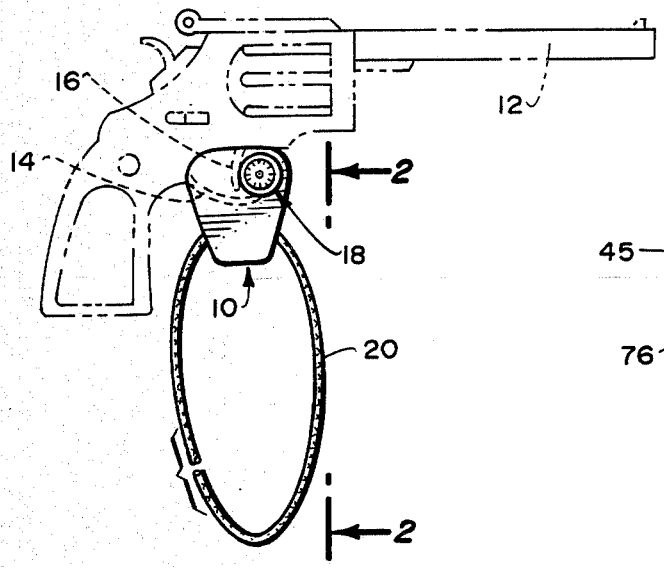
FIG. 1 is a side elevation illustrating attachment of the gun locking device of the present invention to a handgun.
Figure 4A:
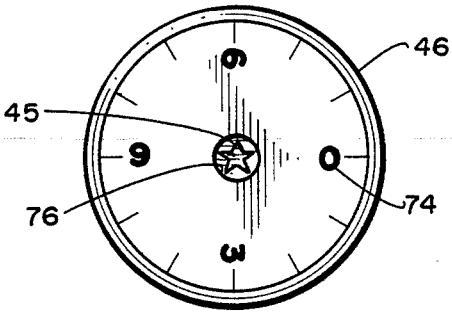
FIG. 4*a* is a view taken at 4*a*—4*a* of FIG. 4.
Figure 2:
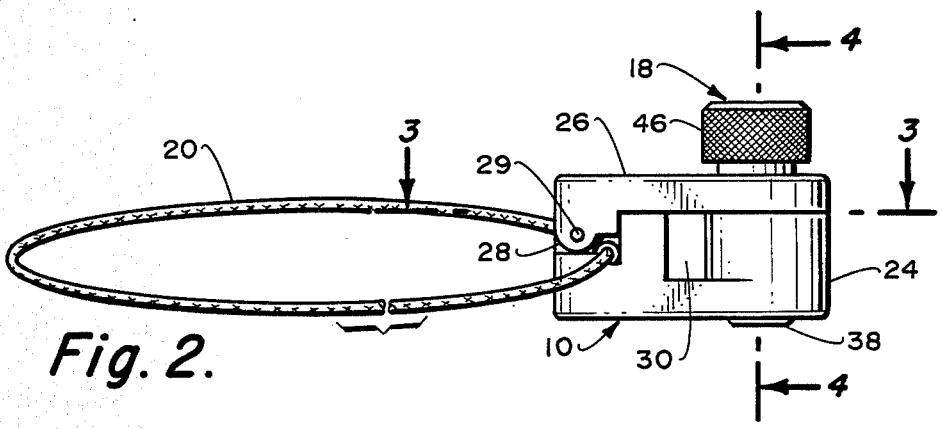
FIG. 2 is a side elevation of the gun locking device taken at 2—2 of FIG. 1.
Figure 3:
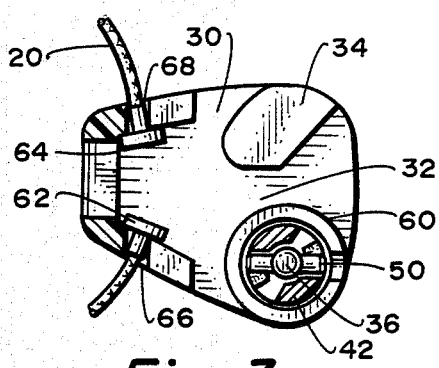
FIG. 3 is a sectional view of the gun locking device taken at 3—3 of FIG. 2.
Figure 4:
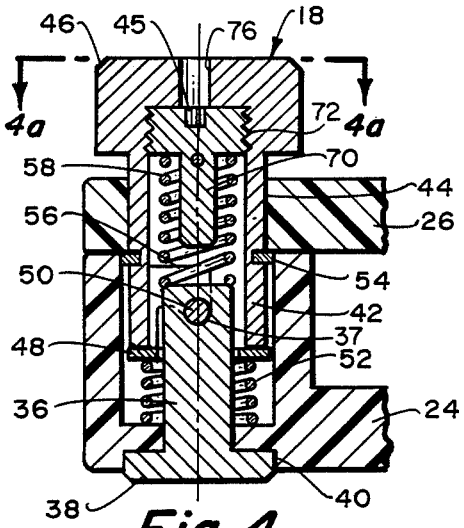
FIG. 4 is a sectional view of the gun locking device illustrating the locking mechanism taken at 4—4 of FIG. 2.

The gun locking device of the present invention is illustrated generally at 10 attached to a handgun 12. While the gun lock is shown attached to a handgun, it can of course be adapted to any type of firearm having a trigger and a trigger guard. It is merely a matter of forming the gun lock 10 in the shape of the trigger guard and trigger for the gun it is to be used with. A completely universal gun lock would be difficult to manufacture since there are many sizes, shapes and designs for triggers and trigger guards for all types of handguns and rifles. However, the principles of construction and operation of the invention disclosed herein are equally applicable to any type of firearm and one design may be adaptable to many different guns.

The gun lock 10 surrounds the trigger guard 14 and trigger 16 preventing any movement. A locking mechanism 18 secures the gun lock 10 to the hand gun 12. Cable 20 is provided for attaching the handgun to some fixed object such as a bedpost, etc.

The details of the gun locking device 10 can be seen more clearly by referring to FIGS. 2 through 6. The gun lock is comprised of a base 24 and a cover 26 connected to the base by a hinge 28 secured by a pin 29. With the lock 18 removed, the hinged cover 26 can open to fit the gun locking device around the trigger guard 14 and trigger 16 of the gun 12. The trigger guard fits in a slot generally indicated at 30 with the hinged portion of the gun lock hanging below the trigger guard. The trigger fits into slots 32. In this manner, the trigger is immobilized when the gun lock is securely fastened to a gun, preventing the gun from firing. The block 34 fits in the space behind the trigger inside the trigger guard 14. The block 34 of course will be designed or shaped to fit a wide variety of guns or a particular gun the gun lock is designed for. That design shown will fit most double action handguns.

A particularly unique feature of the gun locking device of the present invention is the construction and operation of the locking mechanism. This can be seen by referring to FIG. 4. The locking mechanism is comprised of a shaft 36 attached to a head 38 fitted into a recess 40 in the base 24. A latching mechanism is provided by socket 42 fitted into hole 44 in the cover 26. The socket 42 is an extension of the knob 46. The shaft 36 is adapted to lock or latch with pin 50 fitting into the socket 42 when the base 24 and cover 24 are mated around the trigger inside the trigger guard of a gun. In this manner, the lock mechanism 18 secures the base 24 and cover 26, immobilizing the trigger.

The shaft 36 is secured to the base by means of a washer 48 and a pin 50 passing through bore 37 in the shaft. A coil spring 52 is positioned between the washer 48 and the base 24 allowing the shaft to move axially when pressure is applied, either to the end of the shaft or to the washer 48.

The socket 42 is secured to the cover 26 by locking ring 54. The socket is provided with an angled slot 56 (FIG. 6) which can be engaged by the pin 50 fitting bore 37 in shaft 36. A second coil spring 58 between the knob 46 and the end of the shaft 36 biases the socket 42 away from the shaft.

With the construction described, the socket 42 is disengaged from the shaft 36 when necessary, applying an axial motion simultaneously on head 38 of shaft 36 and knob 46. Note that if an axial force is applied to the knob 46 alone, because of dissimilar spring pressure resistance 52 and 58 the shaft 36 and head 38 will move axially with it, preventing the pin 50 from disengaging the the angle slot 56. Thus, to disengage the locking mechanism of the gun locking device according to the present invention, simultaneous oppositely acting axial forces must be applied to the head 38 and knob 46 and the socket 42 to disengage the pin from the angled slot 56. Thus, once the device is placed around the trigger and trigger guard of the hand gun and the two components are mated, both hands are usually required to remove it. This makes it child proof, preventing children from accidentally or easily removing the gun locking device.

Figure 5:
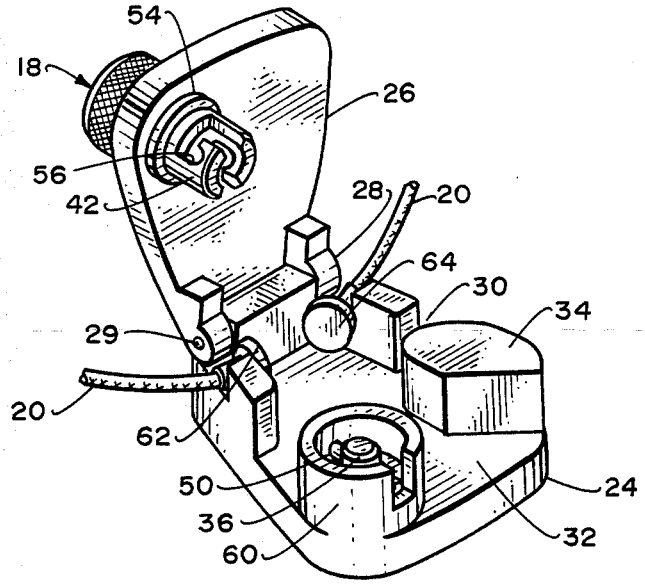
FIG. 5 is a perspective view illustrating the construction and operation of the gun locking device.
Figure 6:
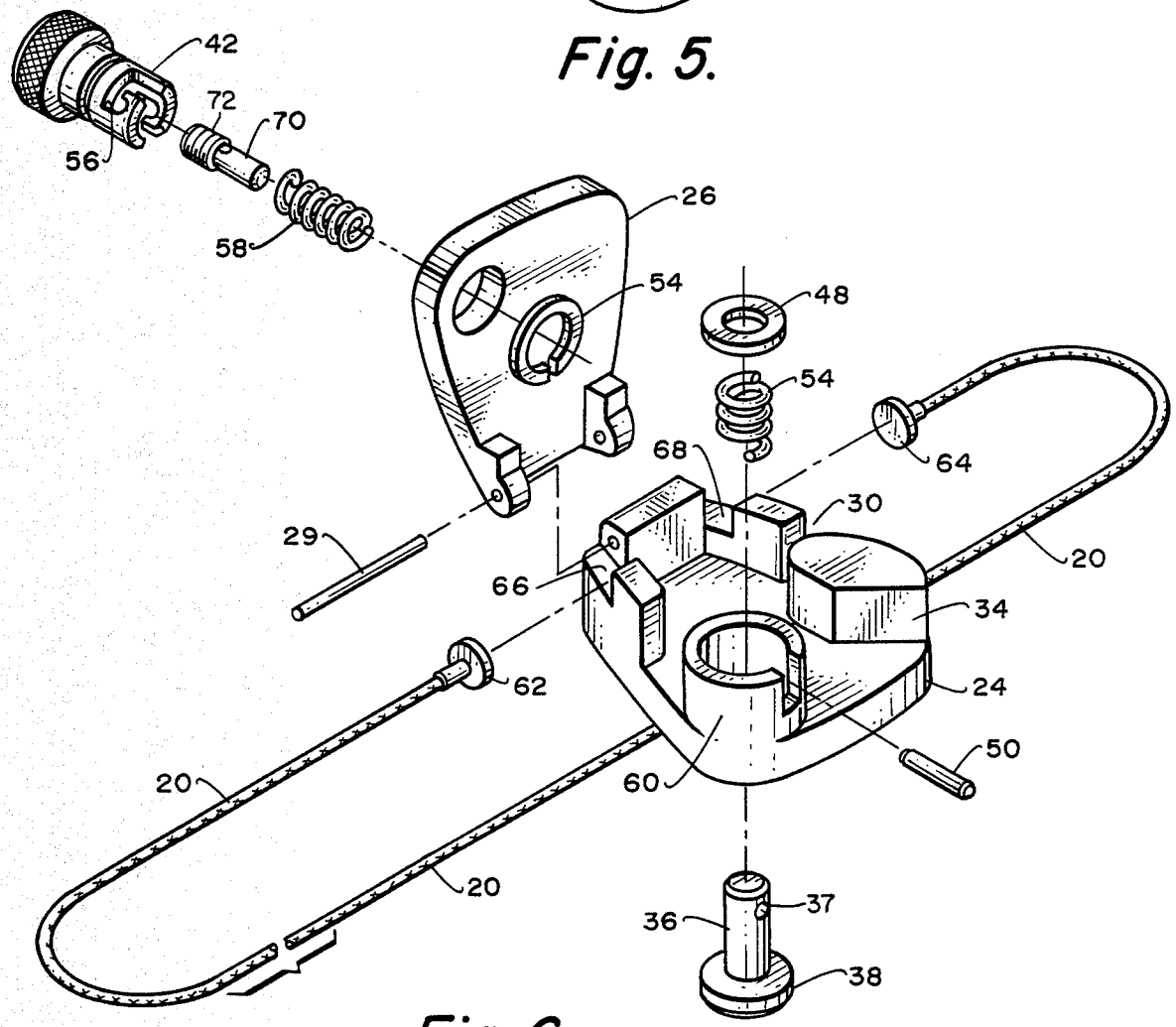
FIG. 6 is an exploded view illustrating the assembly of the gun locking device.

The gun locking device is shown in its open, ready to use position in FIG. 5. The cover 26 has been swung open on the hinge 28 exposing the base 24. In this position, the gun lock is ready for attachment to the trigger guard of a gun. The base 24 is fitted into the trigger guard of a gun with the block 34 passing behind the trigger which fits into the slot 32, between the cylindrical portion 60 and the block 34. The trigger guard fits into the slot 30 beneath the block 34 and cylindrical portion 60. The cover 26 is then swung closed on its hinge 28 and the pin 50 fitted into and mated with the slot 56 to securely fasten the gun lock around the trigger of the gun. Now the gun cannot be used unless the gun locking device is removed. This requires some dexterity and manipulation in that opposite axial forces, as well as rotation of one or both members, is required to release the lock.

An additional feature of the invention is in the provision of a positive locking means to prevent removal of the gun locking device unless a special tool for opening it is used. This is accomplished by means of a set screw 70 having a threaded portion 72 fitting a threaded hole in the knob 46. When the set screw 70 is fully threaded into the knob 46, a space between the end of the set screw and the shaft allows sufficient axial movement of the shaft and the socket to allow pin 50 to be disengaged from the angled slot. With the set screw 70 adjusted to abut the end of the shaft 36 or bottom out (fully collapse) the spring 58, no axial movement of the shaft with respect to the socket is possible, thus providing a positive lock for the gun locking device.

Another feature of the invention is the provision of a locking cable 20 by which the gun can be secured to any permanent fixture such as a post, ring, etc. The cable 20 has sleeves of studs 62 and 64 crimped on each end which fit respectively in slots 66 and 68 between the hinged cover 26 and the base 24 as can be seen clearly in FIGS. 2 and 3. With the cover closed and locked as described herein above, the cable will also be locked inside the gun locking device. Thus, with the cable passed around a fixed object such as a post and the gun locking device securely fastened to the trigger and guard of a gun, the gun is then locked to a post and cannot be removed. Thus, this arrangement allows the cable to be used in conjunction with the gun locking device as an anti-theft device. Additionally, the cable can be used to secure a number of guns, e.g. a plurality of rifles stored in a rack. The cable can be passed through a number of trigger guards of rifles or the like and then locked to the trigger guard of one of the rifles. In this manner, a plurality of rifles will all be locked together or locked to a fixed object. Further, with both ends detachable, the gun locking device can be used with or without the cable. Of course, as a further alternative one end of the cable could be securely attached in one of the slots of the gun lock so that it would always be kept with the lock.

The positive locking set screw 70 and threaded portion 72 provide an additional function. With the head or threaded portion 72 screwed axially toward the shaft 36, an increased force will be applied to the spring 58. Thus, it will require greater force to open the lock. The threaded portion 72, however, must be of sufficient length to permit the set screw 72 or spring collapse to abut the end of shaft 36 while at the same time allowing adjustment to increase or decrease the biasing force of the spring 58 for positive or passive locking action.

In addition to the positive locking and passive locking of the gun locking device according to the invention, there is also provided a deceptive locking arrangement. This is provided in the form of characters 74 inscribed or stamped around the upper surface of the knob 46. The characters will deceive a child or other person into thinking that the gun locking device has a combination lock when it does not.

The hole 76 in the center of the knob 46 provides access to the set screw 70 through opening 45 which can be a keyed socket or an allen head set screw as described. If an allen head set screw is used, it would preferably be a shape which is not commonly used. The particular shape 45 in the form of a star is shown merely by way of example but could be any size and shape to provide keying by a particular keyed tool for positive locking or for adjustment of tension in the locking mechanism.

Thus, there has been disclosed a gun locking device which has a passive locking system, in addition to a positive locking system and a deceptive locking system. The passive locking system allows the device to be instantly opened even in the dark once a user knows the secret to opening it. Thus, there is no key to fumble with when trying to open it in the dark. However, an additional positive key locking system is provided in the form of a particularly keyed set screw which will lock the device, preventing it from being removed without a special tool. Lastly, the deceptive locking systen is provided to give the device the appearance of a combination lock. The combination lock appearance will instantly discourage children as well as some adults from even attempting to gain entry to the gun. In addition to the multifunctioned locking device having a passive setting for substantially child proof locking and a positive setting for true locking protection, an anti-theft attachment is provided in the form of a cable instantly secured to the device, which can lock the gun to a bedpost or other fixed object.

Obviously, many modifications and variations of the invention are possible in light of the above teachings. It is therefore to be understood that the invention is not to be limited by the embodiment shown in the drawings and described in the description which is given by way of example and not of limitation but only in accordance with the scope of the appended claims.

We claim:

1. A gun locking device comprising;

a first member;

a second member;

said first and second members constructed to mate around a gun trigger;

interconnecting means interconnecting to secure said first and second members around said trigger comprising;

a pair of axially aligned latch members having means latching said pair of axially aligned latch members together; said latch means constructed and arranged to require opposite axial and rotational forces to be simultaneously applied to said pair of latch members for unlatching and removing said first and second members.

2. The device according to claim 1, in which said latch means comprises shaft means;

socket means;

said shaft means and socket means being mounted on said first and second members for relative axial movement toward and away from one another;

said latch means latching said shaft means and said socket means when said shaft means and said socket means are axially and rotationally moved simultaneously toward one another.

3. The device according to claim 2, in which said latch means comprises;

an angled slot in said socket means;

pin means adjacent the end of said shaft means extending outward substantially perpendicular to the axis of said shaft means;

said pin means and said angled slot constructed to interconnect when said socket means and said shaft means are simultaneously moved toward one another and rotated thereby locking said pin means in said angled slot.

4. The device according to claim 3 including biasing means biasing said shaft means and said socket means away from each other when they are interconnected.

5. The device according to claim 4 in which said biasing means comprises at least one spring means between said shaft means and said socket means.

6. The device according to claim 5 in which said at least one spring means comprises a coil spring between said pin means and one of said members for retaining said shaft means axially movable on said member whereby an axial force applied to either said socket means or said shaft means causes both said socket means and said shaft means to move axially in the same direction thereby preventing disconnection.

7. The device according to claim 5 including a second coil spring in said socket means between a bottom of said socket and the end of said shaft means whereby an additional separating force is applied between said socket means and said shaft means when connected.

8. The device according to claim 3 in which:

said pin means comprises a pin passing through and extending outward on opposite sides of said shaft means;

said at least one angled slot comprising a pair of angled slots on opposite sides of said socket means adapted to receive said pin extensions.

9. The device according to claim 1 in which;

said first member comprises a base means shaped to fit a trigger guard having shoulders adapted to surround and immobilize a gun trigger;

said second member comprises a cover means secured to said base means.

10. The device according to claim 9 in which said cover means is hingedly attached to said base means.

11. The device according to claim 10 in which said shaft means is secured to one of said members;

said socket means is secured to the other of said members whereby when said members are mated said shaft means engages and interconnects with said socket means.

12. The device according to claim 11 including locking means for locking said shaft means to said socket means after they are interconnected.

13. The device according to claim 12 in which said locking means includes means for limiting the axial displacement of said shaft means thereby preventing separation once they are interconnected.

14. The device according to claim 13 in which said means for limiting axial displacement of said shaft means comprises means for varying the depth of said socket means.

15. The device according to claim 14 in which the means for varying the depth of said socket means comprises:

a knob on said socket means, said knob having a threaded hole coaxially aligned with said socket means;

a threaded set screw threaded into said threaded hole, said set screw extending into said socket means;

means for adjusting said threaded set screw so that it adjustably extends into said socket means thereby varying the depth of said socket means to prevent disengagement of said shaft means from said socket means.

16. The device according to claim 15 in which said means for adjusting said threaded set screw comprises;

a tool socket in the end of said threaded set screw;

a tool adapted to fit said tool socket in said set screw so that said set screw may be threaded toward or away from said socket means.

17. The device according to claim 15, including; characters formed on an external visible surface of said knob providing a deceptive appearance of a combination lock.

18. The device according to claim 16 in which said tool socket in said threaded set screw has a predetermined nonstandard shape; said tool having a matching shape whereby said tool is keyed to said tool socket.

19. The device according to claim 16, in which said threaded hole comprises; a first threaded portion extending from said socket partially into said knob and a second coaxial portion smaller in diameter than the first threaded portion thereby providing access to and retaining said threaded set screw between said socket means and said knob.

20. The device according to claim 17 in which said second coaxial portion of said threaded hole portion is slightly larger in diameter than the socket in the end of said threaded set screw.

21. The device according to claim 16 in which the threads in said threaded hole extend only a portion of the way through said knob from said socket means whereby said threaded rod is retained in said socket means.

22. The device according to claim 1 including cable means;

means for retaining respective ends of said cable means between said first and second members when said first and second members are secured together.

23. The device according to claim 22 in which said cable means comprises;

stud with sleeve means crimped and secured to each end of a cable;

said first and second members having receptacles formed by cutouts in the respective members for receiving and retaining said studs secured to the ends of said cable when said members are mated around a trigger whereby said cable may pass around and secure a gun to an object.

24. A gun locking anti-theft device comprising;

a first member;

a second member;

said first and second members constructed to mate around a gun trigger to prevent operation of said trigger;

securing means securing said first and second members around said trigger;

cable means having its ends retained between said first and second members when said first and second members are secured around a gun trigger;

one of said first or second members having slot means for receiving and retaining the ends of said cable means clamped between said first and second members.

25. The device according to claim 24 in which one end of said cable means is securely fastened to one of said members; the other end of said cable means being free to pass around an object and be inserted in a slot means thereby securing said gun to said object.

26. The device according to claim 25 in which said first and second members are adapted to mate and fit around a trigger guard and trigger; one of said first or second members having a slot into which said cable fits and is secured by when said members are secured to a trigger guard.

27. The device according to claim 24 in which said cable means comprises;

studs with sleeve means crimped and secured to each end of a cable;

said first and second members having receptacles formed by cutouts in the respective members for receiving and retaining said studs secured to the ends of said cable when said members are mated around a trigger whereby said cable may pass around and secure a gun to an object.

* * * * *